US006025804A

United States Patent [19]

Davis et al.

[11] Patent Number: 6,025,804

[45] Date of Patent: Feb. 15, 2000

[54] ANTENNA WITH ABSORPTIVE RADIATION SHIELD

[75] Inventors: James Lynn Davis, Parkland; Robert W. Pennisi, Boca Raton; Glenn F. Urbish, Coral Springs, all of Fla.

[73] Assignee: Motorola, Inc., Schaumburg, Ill.

[21] Appl. No.: 08/578,404

[22] Filed: Dec. 26, 1995

[51] Int. Cl.[7] ..... H01Q 1/24

[52] U.S. Cl. ..... 343/702; 343/841; 343/873

[58] Field of Search ..... 343/702, 841, 343/873; H01Q 1/24

[56] References Cited

U.S. PATENT DOCUMENTS 5,507,012 4/1996 Luxon et al. ..... 343/702

*Primary Examiner*—Michael C. Wimer

*Attorney, Agent, or Firm*—M. Mansour Ghomeshi

[57] ABSTRACT

An antenna (100) includes a radiating element (202) covered with a protective jacket having at least one pocket selectively located therein. The at least one pocket (102) is filled with a material (105) having an absorptive index substantially higher than the index of the protective jacket (102). This material imposes substantial restriction to the free radiation of radio frequency energy. Conversely, the remainder of the jacket (102) with no pockets provides for the unrestricted radiation of the radio frequency energy therethrough. As a result the antenna (100) directionally radiates energy without the use of reflectors or additional radiating elements.

14 Claims, 3 Drawing Sheets

ANTENNA WITH ABSORPTIVE RADIATION SHIELD

TECHNICAL FIELD

This invention is generally related to antennas and more particularly to antennas used with portable communication devices.

BACKGROUND

Portable communication devices, such as cellular telephones generally use a vertically mounted antenna for the transmission and reception of radio frequency signals. Several types of antennas, such as half-wave and quarter-wave are presently used with such devices. A problem with present antennas is the capacitive and inductive coupling to the body of the user. This body coupling degrades the performance of the antenna, and ultimately the communication device, due to reflection, diffraction and dissipation by the Joule effect of the RF (Radio Frequency) energy by the body of the user. A very common antenna is the quarter-wave whip and physically shorter quarter-wave antenna which is popular due to its size. The radiation patterns of quarter-wave antennas tend to have a deep null behind the head of the person holding the radio. This null can not be accurately characterized as the holding position of the radio changes from one user to the next. Indeed, the closer the radio is held to the body the deeper this null. Since some radio applications demand that the user hold the radio to their ear, e.g. cellular phones, the designer is forced to compromise the performance of the radio in order to achieve the device's intended use.

One solution to this problem is to locate the antenna remotely. In addition to cost disadvantages, this solution is bulky and not user friendly. Other solutions involve the use reflectors to render the antenna directional. The problem with using reflectors is that the antenna grows in size and may not be well suited for portable applications.

It can be seen that an antenna is desired that overcomes the performance problems of the prior art without sacrificing the convenience

DETAILED DESCRIPTION OF THE PREFERRED EMBODIMENT

Figure 1:
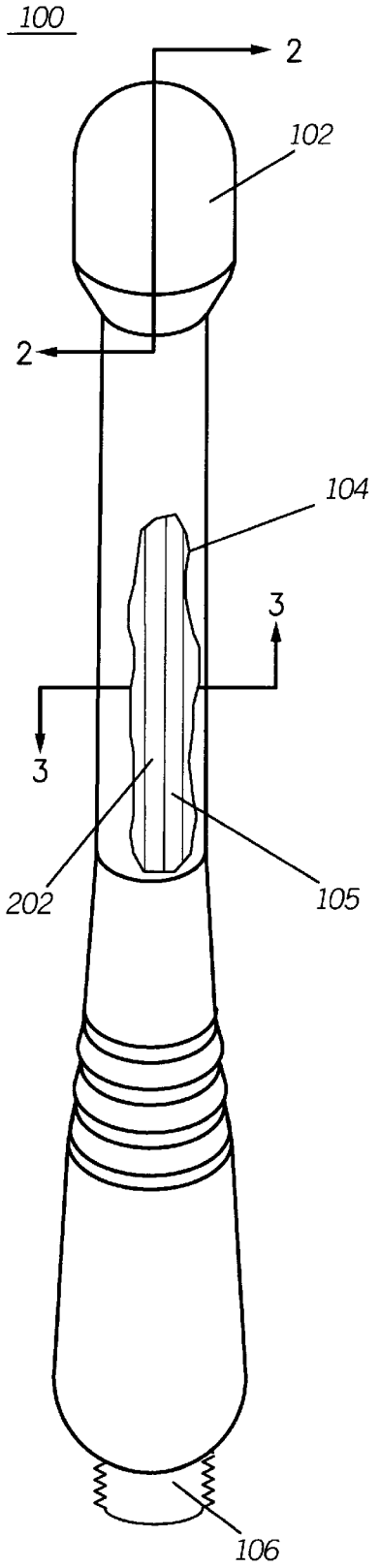
FIG. 1 shows an isometric view of an antenna in accordance with the present invention.
Figure 2:
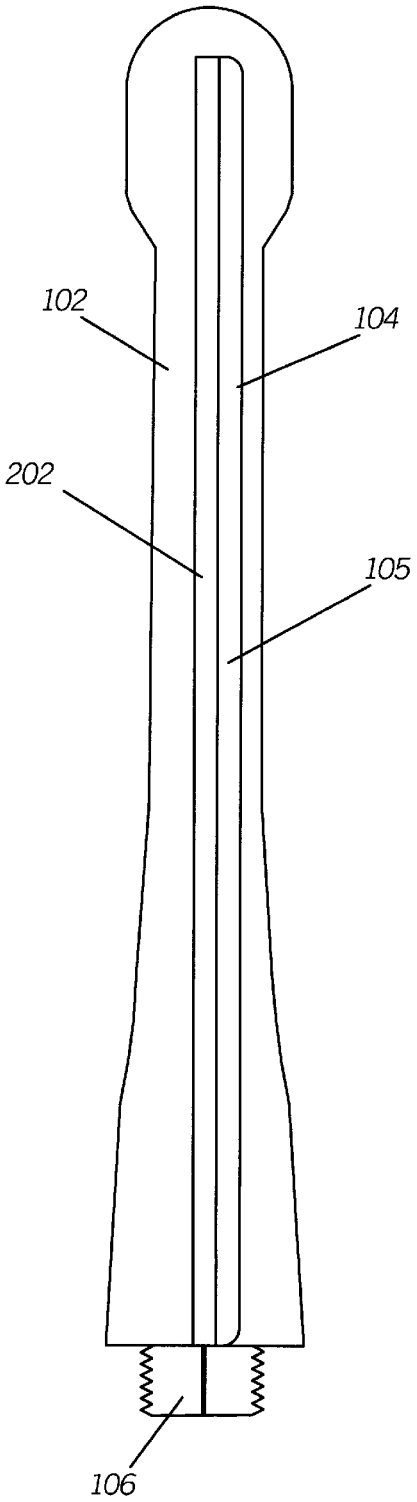
FIG. 2 shows a side cross-sectional view of the antenna of FIG. 1.
Figure 4:
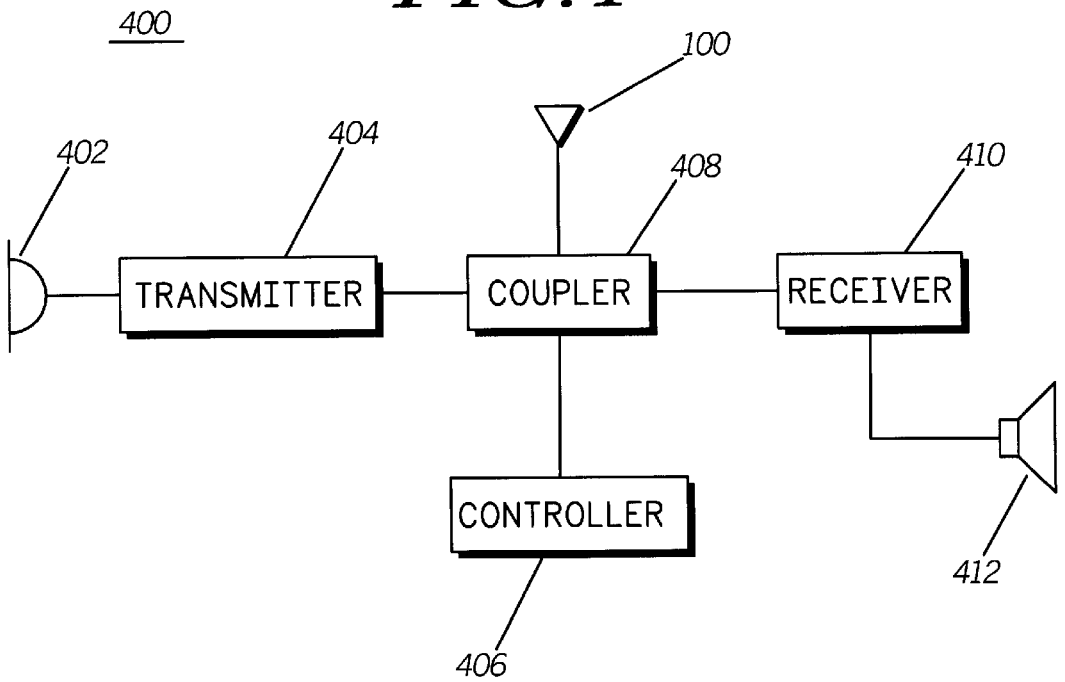
FIG. 4 shows a communication device in accordance with the present invention.

Referring to FIGS. 1 and 2, an isometric view and a cross sectional view, respectively, of an antenna 100 such as an end-fed antenna, a sleeve dipole antenna, or a quarter-wave whip antenna is shown. The antenna 100 includes a radiating element 202 coupled to a connector 106. This connector 106 is used for the mechanical and electrical coupling of the antenna 100 to a transmitter 404 (FIG. 4). The radiating element 202 is used to radiate a radio frequency signal at a desired power level generated by the transmitter 404 and coupled thereto via the connector 106. The radiating element 202 radiates energy in all directions, hence rendering the antenna 100 isotropic.

Covering all or a portion of the radiating element 202 is a protective jacket or radome 102. This jacket 102 substantially covers the length of the radiating element 202. Indeed, in many applications the jacket 102 extends well beyond the radiating element 202. The jacket 102 includes at least one recess or pocket 104 selectively located along all or a portion of the length of the radiating element 202. An absorptive material, such as a gel 105 is placed in the pocket 104 in order to selectively restrict the radiation of radio frequency energy. This pocket 104 may be in the form of a sack suitable for accommodating the absorptive gel 105. The material of the jacket 102 has a first absorptive index which is substantially less than that of the gel 105. In accordance with the present invention, the jacket 102 is made of materials with low absorptive indices such as polyethylene, polypropylene, Teflon®, polyolefin, silicone, polystyrene, or derivatives of these polymers with low filler content. Conversely, the gel 105 is made of materials, such as hydrogels,ionic species dissolved in gels, or ionic solutions. The second portion can either be a free standing medium inserted into the antenna coating or can be contained in a sack. Examples of hydro-gel materials which can be used in this application include, but are not limited to starches, cellulosics, and natural gums. All of these materials absorb many times their own weight of water and/or electrolytes to form gels. Other absorptive materials which can be used in this application include the following, individually or in combination: poly(ethylene oxide) (PEO), poly(vinyl alcohol) (PVA), poly[bis(2-(2-methoxy-ethoxy)ethoxy) phosphazene] (MEEP), and acrylamides combined with water and/or ionic materials such as acids and salts. Other ionic solutions which could be used in this application include salts, acids, and/or bases dissolved in polar media such as water, acetonitrile, tetrahydrofuran, and cellosolves. Alternatively, the absorptive material 105 may be any gel with dissolved electrolyte or solutions containing dissolved electrolyte. As a result, the energy radiated by the radiating element 202 is absorbed in areas where the pocket 104 covers the radiating element 202. Conversely, little or no resistance is presented to the radiation of energy in areas where no pockets, hence no absorptive gel are present.

In other words, the lossy composition of the material of the gel 105 substantially curtails the radiation of radio frequency energy. Conversely, the low loss material of the first portion 102 provides for the radiation of the radio frequency signal with minimum obstruction. The result is a directional antenna that can be used reliably and predictably without the need for additional radiators or reflectors. The location of the pockets 104 may be identified with a color coating on the jacket 102 in order to provide the user with an indication of the direction of the radiated energy.

In an alternative embodiment of the present invention, the pocket 104 may be placed on the outside of the jacket 102 and filled with the gel 105. Similarly, this embodiment provides for the alteration of the radiation pattern in a desired fashion in order to provide the antenna 100 with enhanced selectivity in directional radiation.

Figure 3:
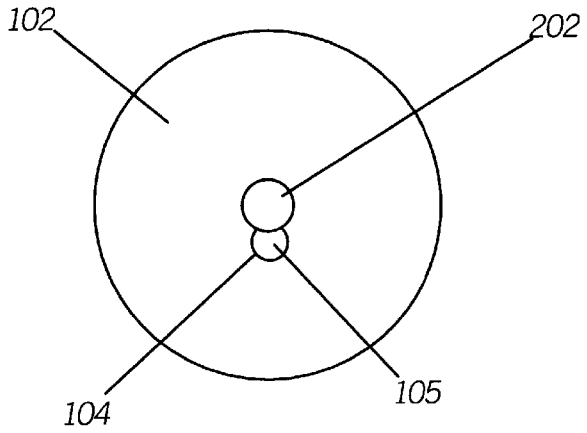
FIG. 3 shows a top cross-sectional view of the antenna of FIG. 1.

Referring to FIG. 3, a top cross-sectional view of the antenna 100 in accordance with the present invention is shown. As can be seen, the radiating element 202 is surrounded with the jacket 102 with selective pockets 105 therein. The two materials chosen for the jacket 102 and the gel 105 in the preferred embodiment restrict radiation in desired directions while providing for the free and unobstructed radiation of energy in all other directions. The result is a directional antenna without the use of additional radiating elements or reflectors.

In summary, an antenna with absorptive electromagnetic shield is constructed by encasing the radiator 202 in a polymer coating having an exterior section and an interior section. The interior section is located in selective areas of the radiating element for rendering the antenna directional. The directionality of the antenna is brought about by the material used in the construction of the interior section. In the preferred embodiment, the interior section includes a pocket in which an absorptive gel rests. The gel consists of a material that exhibits a high dielectric loss tangent (i.e. tand) over the frequency range of interest. A variety of gels may be used to accomplish the objectives of the present invention. One such gel may contain one or more dissolved ionic salts. Alternatively, gels containing one or more molecules which absorb in the frequency range of interest may be used to fill the pocket formed by the interior section.

In general, adding ions to an electrolyte creates charge carriers in the gel (both electronic and ionic) which will have two effects upon electromagnetic radiation at RF frequencies. First, the charge carriers will oscillate with the electromagnetic radiation creating an effective screening of the radiation in much the same way that Gauss's Law predicts the screening of electrical charges by an ideal conductor. A second effect is experienced due to the fact that the gel material is not ideal. These two effects added together function to make an effective electromagnetic radiation absorber over a wide frequency range which depends on the materials that are chosen.

An alternative class of gel technology that can be used in the present invention are gels which contain one or more additives that absorb in a desired frequency range. The absorption process does not have to be resonant, but should be of sufficient intensity to block a substantial portion of the radiation. Examples of these types of gels are hydro-gels, which contain water dispersed in the gel matrix which is highly absorptive to electromagnetic radiation.

Figure 5:
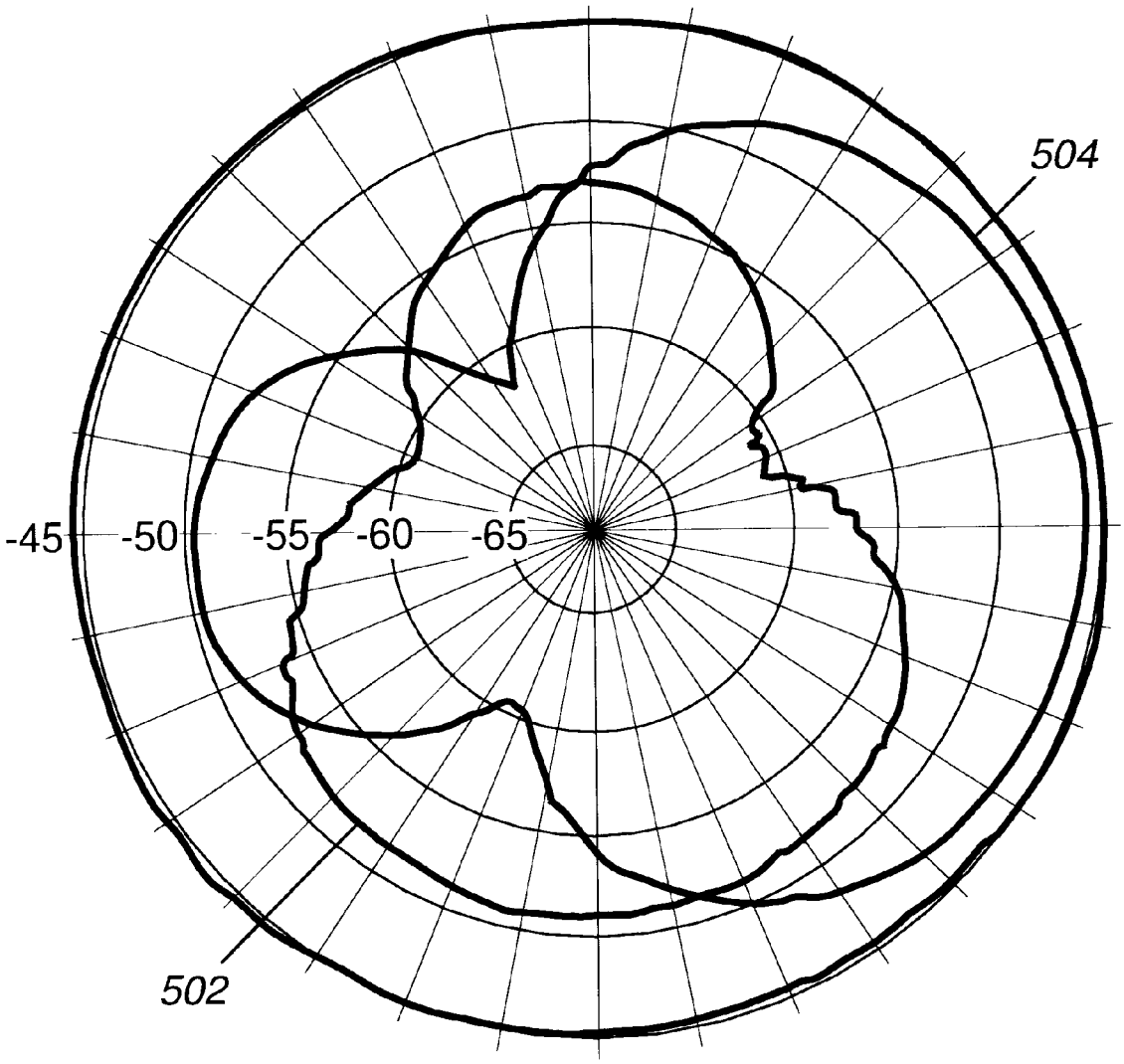
FIG. 5 shows radiation patterns of two antennas constructed in accordance with the present invention.

The present invention will be better understood by referring to the following examples in association with the radiation patterns of FIG. 5.

EXAMPLE 1

In this experiment, a container (sack) was filled with Expo® brand white board cleaner which is a dissolved electrolyte in a solution and which is available from Sangfroid corporation, Bellwood, Ill. 60104. This container was placed around a portion of the radiating element of a quarter wave dipole antenna in accordance with the present invention. The azimuthal radiation pattern of the antenna was then measured on a ground plane in an anechoic chamber and compared to the performance of the same antenna with no absorber. The presence of the absorber resulted in some overall attenuation of electromagnetic radiation, but produced specific nulls in the radiation pattern. The selective placement of this absorber (gel) results in a directional antenna in accordance with the present invention as shown by plot 502.

EXAMPLE 2

In this experiment, a second absorber was created by using water and blue RayChem GelTek strips (available from Raychem Company, Menlo Park, Calif. 94025 under part number GTS-1020-1-R25) and placed around a portion of the radiating element of a quarter wave dipole antenna in accordance with the present invention. The azimuthal radiation pattern of the antenna was then measured on a ground plane in an anechoic chamber and compared to the performance of the same antenna with no absorber. For this absorber, no attenuation of the maximum gain was observed in the forward direction, but significant reduction in radiation was observed in the area of the absorber as shown by plotted pattern 504. This absorption created nulls in the radiation pattern, which are beneficial as described above.

A benefit of the present invention is that a directional antenna may be constructed without the use of a reflector or a second radiator. Indeed, any presently available antennas such as sleeve dipole, end-fed, quarter wave whip may take advantage from the principles of the present invention. By using a radiator which is partially covered by materials with different absorptive indices a directional antenna may be constructed that will not be any more bulky than a regular non-directional antenna. Therefore, the need for reflectors or additional radiators in making directional antennas is eliminated.

Another benefit of the present invention may be realized by selectively placing the radiation null formed by the absorptive material of the gel 105 around the body of the user. With little to no radiation directed towards the body of the user the effect of the body capacitance is minimized on the radiated energy. The reduction in the interference from the body capacitance results in avoiding nulls otherwise created by the user, hence providing for a more efficient transmitter.

Referring to FIG. 4, a block diagram of a communication device is shown. The transmitter 404 is used for the transmission of signals received through a microphone 402. A receiver 410 couples received signals to a speaker 412. The antenna 100 is coupled to the transmitter 404 and the receiver 410 through a coupler 408. This coupler 408 provides for switching between the transmitter 404 and the receiver 410 when directed by controller 412.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An antenna, a radiating element having a length for radiating a radio frequency energy;

a jacket for physically protecting the entire length of the radiating element, the jacket having at least one open pocket selectively located along the length of the radiating element; and an absorptive gel material having an absorptive index substantially higher han that of the jacket and placed in the at least one open pocket in order to selectively restrict the radiation of radio frequency energy.

2. The antenna of claim 1, wherein the jacket includes a polyolefin jacket.

3. The antenna of claim 1, wherein the material used in the construction of the jacket includes derivatives of polyolefin.

4. The antenna of claim 1, wherein the gel includes gels with dissolved electrolytes.

5. The antenna of claim 1, wherein the gel includes solutions containing dissolved electrolytes.

6. The antenna of claim 1, further including a connector.

7. The antenna of claim 1, wherein the absorptive material is selected from the group consisting of poly(ethylene oxide)

(PEO) poly(vinyl alcohol) (PVA), poly[bis(2-(2-methoxyethoxy)ethoxy), phosphazene] (MEEP), or a combination thereof.

8. An antenna, comprising:

a radiating element having a length for radiating a radio frequency signal at a desired power level to produce radiated energy;

a radome for covering the entire length of the radiating element and providing protection thereto, the radome including at least one open pocket selectively located along the length of the radiating element; and an absorptive gel material placed in the at least one open pocket in order to guide the radiated energy in a desired direction.

9. The antenna of claim 8, wherein the radome includes a material with a low absorptive index.

10. The antenna of claim 8, wherein the absorptive material includes a material having an absorptive index higher than the absorptive index of a material used by the radome.

11. A communication device, comprising:

a radio transmitter section for transmitting a radio frequency signal at a desired power;

an antenna coupled to the transmitter section for radiating the radio frequency signal to produce radiated energy, the antenna comprising:

a radiating element coupled to the transmitter section, the radiating element having a length along which radio frequency energy generated by the transmitter is radiated;

a protective cover made of a first material and positioned over the length of the radiating element and adapted to provide the antenna with direction radiation of the radio frequency energy, the cover being made of a material with minimum absorptive index in order to provide the least amount of restriction to the radiation of the radio frequency energy, the cover including at least one recess selectively located along the length of the radiating element; and a second gel material used to fill the at least one recess in the protective cover, the second material having an absorptive index greater than the absorptive index of the protective cover in order to provide substantial restriction to the radiation of the radio frequency energy along a portion of the length of the antenna.

12. The communication device of claim 11, wherein the antenna includes a sleeve dipole antenna.

13. The communication device of claim 11, wherein the antenna includes an end-fed antenna.

14. The communication device of claim 11, wherein the antenna includes quarter-wave whip antenna.

* * * * *